US009733038B2

(12) United States Patent
Bondar

(10) Patent No.: US 9,733,038 B2
(45) Date of Patent: Aug. 15, 2017

(54) FIREARM CLEANING DEVICE

(71) Applicant: Veniamin Bondar, Auburn, WA (US)

(72) Inventor: Veniamin Bondar, Auburn, WA (US)

( * ) Notice: Subject to any disclaimer, the term of this patent is extended or adjusted under 35 U.S.C. 154(b) by 12 days.

(21) Appl. No.: 15/000,516

(22) Filed: Jan. 19, 2016

(65) Prior Publication Data

US 2017/0108306 A1 Apr. 20, 2017

Related U.S. Application Data

(60) Provisional application No. 62/244,014, filed on Oct. 20, 2015.

(51) Int. Cl.

| | |
|---|---|
| ***F41A 29/02*** | (2006.01) |
| ***A46B 5/00*** | (2006.01) |
| ***A46B 5/02*** | (2006.01) |
| ***A46B 9/02*** | (2006.01) |
| ***A46B 13/02*** | (2006.01) |
| ***A46B 15/00*** | (2006.01) |

(52) U.S. Cl.

CPC ..... *F41A 29/02* (2013.01); *A46B 5/0095* (2013.01); *A46B 5/026* (2013.01); *A46B 9/026* (2013.01); *A46B 13/02* (2013.01); *A46B 15/0036* (2013.01)

(58) Field of Classification Search

CPC ..... F41A 29/02; A46B 5/0036; A46B 5/0095

USPC ..... 42/95; 15/104.09, 104.095, 22.1, 23, 28; 362/91

See application file for complete search history.

(56) References Cited

U.S. PATENT DOCUMENTS

| | | | | |
|---|---|---|---|---|
| 3,407,431 | A * | 10/1968 | Melnik | B25F 5/008 15/23 |
| 3,746,960 | A * | 7/1973 | Fraser | B43L 19/0006 310/50 |
| 4,476,602 | A * | 10/1984 | Hurn | A46B 13/02 15/28 |
| 5,809,601 | A | 9/1998 | Rivera | |
| 8,429,781 | B2 | 4/2013 | Subramanian | |
| 2003/0097724 | A1 | 5/2003 | Park | |
| 2006/0215391 | A1 * | 9/2006 | Jones | A46B 15/0002 362/91 |

(Continued)

FOREIGN PATENT DOCUMENTS

| | | | | |
|---|---|---|---|---|
| CH | 692825 | * | 11/2002 | F61A 29/02 |

OTHER PUBLICATIONS

PCT International Search Report and Written Opinion for International Application No. PCT/US2016/057460 dated Jan. 25, 2017.

*Primary Examiner* — Laura C Guidotti

(74) *Attorney, Agent, or Firm* — Eversheds Sutherland (US) LLP

(57) ABSTRACT

A firearm cleaning device is disclosed herein. The device may include a housing comprising a grip portion, a motor housing portion opposite the grip portion, a neck portion disposed between the grip portion and the motor housing portion, and a slot disposed adjacent to the neck portion between the grip portion and the motor housing portion. The device also may include a motor disposed within the motor housing portion and a battery disposed within the grip portion. The battery may be electrically coupled to the motor. In addition, the device may include a shaft coupled to the motor and extending out of the motor housing portion, a detachable brush attachable to the shaft, and a motor switch disposed about the housing opposite the slot for activating the motor.

4 Claims, 6 Drawing Sheets

(56) References Cited

U.S. PATENT DOCUMENTS

| | | | |
|---|---|---|---|
| 2013/0199072 | A1 | 8/2013 | Richter |
| 2014/0053353 | A1 | 2/2014 | An |

* cited by examiner

FIREARM CLEANING DEVICE

CROSS-REFERENCE TO RELATED APPLICATIONS

The disclosure claims priority to and the benefit of U.S. provisional application No. 62/244,014, filed Oct. 20, 2015, which is incorporated by reference herein in its entirety.

FIELD OF THE DISCLOSURE

The disclosure generally relates to firearms and more particularly relates to a firearm cleaning device.

BACKGROUND

When a firearm is discharged, the firing chamber may become contaminated with various types of combustion residue. Said residue, if allowed to collect, can cause the firearm to malfunction. Firearms that fire multiple times, such as semi-automatic and automatic rifles, may rapidly accrue residue, which may be detrimental to the operability of the firearm. The firing chamber can also be contaminated by foreign debris, such as sand, mud, or dirt.

Typical firearms require a degree of disassembly to effectively remove debris from the firing chamber. Furthermore, certain military and civilian firearms, such as the AR-15 and M-16 class firearms, have a portion of the chamber that is difficult to clean effectively even when disassembled.

As noted above, firearm effectiveness relies in part upon the cleanliness of the firing chamber. In conventional cleaning methods, a chamber brush is mounted on a standard cleaning rod and the rifle is disassembled to allow access to the firing chamber. It is widely agreed, however, that disassembly of a firearm in a combat or personal defense situation is not considered practical. Thus, a need exists for a system that cleans the firing chamber of a firearm quickly and in a thorough manner without the need to disassemble the firearm.

SUMMARY

Some or all of the above needs and/or problems may be addressed by certain embodiments of the firearm cleaning device disclosed herein. The firearm cleaning device may include a housing comprising a grip portion, a motor housing portion opposite the grip portion, a neck portion disposed between the grip portion and the motor housing portion, and a slot disposed adjacent to the neck portion between the grip portion and the motor housing portion. The firearm cleaning device also may include a motor disposed within the motor housing portion and a battery disposed within the grip portion. The battery may be electrically coupled to the motor. In addition, the firearm cleaning device may include a shaft coupled to the motor and extending out of the motor housing portion, a detachable brush attachable to the shaft, and a motor switch disposed about the housing opposite the slot for activating the motor.

Other features and aspects of the firearm cleaning device will be apparent or will become apparent to one with skill in the art upon examination of the following figures and the detailed description. All other features and aspects, as well as other system, method, and assembly embodiments, are intended to be included within the description and are intended to be within the scope of the accompanying claims.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Figure 1:
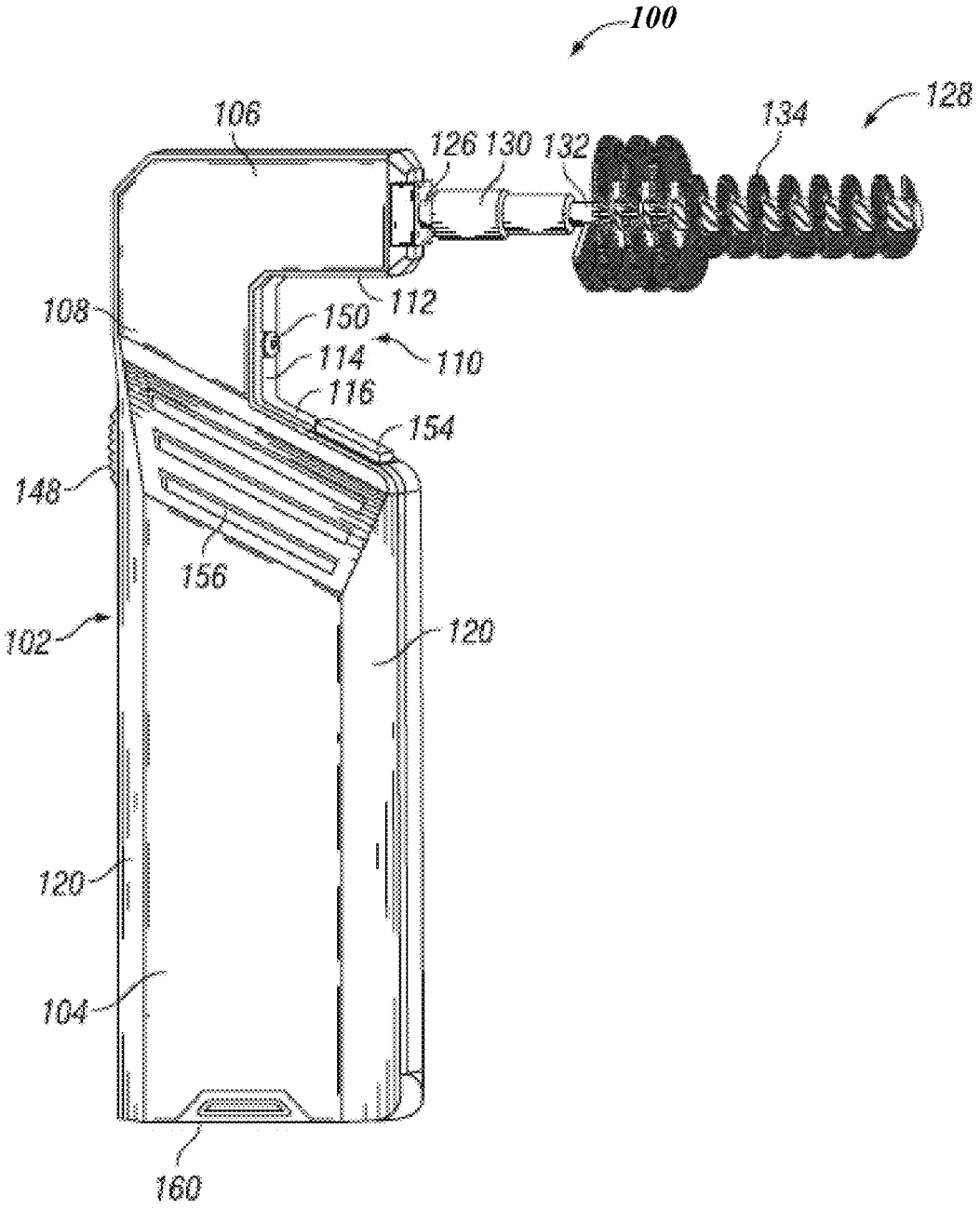
FIG. 1 depicts a firearm cleaning device in accordance with one or more embodiments of the disclosure.

Described below are embodiments of a firearm cleaning device (as well as individual components of the firearm cleaning device) that can be used to clean a firearm. The firearm may be a conventional firearm. For example, the firearm may be an M-16 style rifle, an AR-15 style rifle, an AR-10 style rifle, or an M-4 style rifle, among others. The firearm may be a handgun or a shotgun. Any firearm may be used. The firearm cleaning device may be used to clean the firing chamber and/or barrel of a firearm. For example, the firearm cleaning device may be inserted into the ejection port or the like of a firearm. The firearm cleaning device may be inserted into a barrel of a firearm. The firearm cleaning device may be inserted into any portion of a firearm. In this manner, the firearm cleaning device may be used to clean any portion of a firearm. In some instances, the firearm cleaning device may be capable of cleaning the firearm without disassembling of the firearm. In other instances, the firearm cleaning device may be used to clean a disassembled firearm.

Generally speaking, the firearm cleaning device may include a housing comprising a grip portion, a motor housing portion opposite the grip portion, a neck portion disposed between the grip portion and the motor housing portion, and a slot disposed adjacent to the neck portion between the grip portion and the motor housing portion. In some instances, the grip portion may include one or more angled surfaces for providing a visual and tactile alignment reference for correct insertion of the firearm cleaning device into the firing chamber of a firearm. The housing may be any size, shape, or configuration.

The firearm cleaning device also may include a motor disposed within the motor housing portion and a battery disposed within the grip portion. The battery may be electrically coupled to the motor. The motor may be any suitable electrical motor, and the battery may be any suitable battery capable of providing adequate power to the motor.

A shaft may be coupled to the motor. The shaft may extend at least partially out of the motor housing portion. In this manner, a detachable brush may be attached and detached to and from the shaft. In some instances, a brush or the like may be permanently attached to the shaft. In some instances, a reduction gear may be disposed between the motor and the shaft. The detachable brush may include a shaft coupling and bristles. The shaft coupling may be threaded onto the shaft. That is, the shaft may include external threads and the shaft coupling may include complementary internal threads. That is, the detachable brush may include female threads. Any attachment means may be used to attach and detach the detachable brush to the shaft.

The bristles may be any size, shape, or configuration. In some instances, the bristles may be variable sized bristles. In other instances, the bristles may be uniform. In certain embodiments, a brush sock may be positioned over the detachable brush.

The firearm cleaning device may include a motor switch disposed about the housing opposite the slot. The motor switch may be located anywhere about the housing. The motor switch may be used for activating the motor. In some instances, the motor switch may include an actuator knob. The firearm cleaning device also may include a light disposed on the neck portion within the slot. In some instances, the light may be an LED light or the like. The light may be any type of light. The light may be any size, shape, or configuration. A light switch may be disposed on the grip portion within the slot. The light switch may be located anywhere about the housing. The light switch may be used for activating the light. The light switch may include an actuator knob.

The firearm cleaning device also may include one or more ventilation slits in the housing, a lanyard attachment point disposed about the housing, and a removable panel attachable to the grip portion for accessing the battery within the grip portion.

These and other embodiments of the disclosure will be described in more detail through reference to the accompanying drawings in the detailed description of the disclosure that follows. This brief introduction, including section titles and corresponding summaries, is provided for the reader's convenience and is not intended to limit the scope of the claims or the proceeding sections. Furthermore, the techniques described above and below may be implemented in a number of ways and in a number of contexts. Several example implementations and contexts are provided with reference to the following figures, as described below in more detail. However, the following implementations and contexts are but a few of many.

FIGS. 1-7B depict a firearm cleaning device 100 (as well as individual components of the firearm cleaning device 100) that can be used to clean a firearm. The firearm cleaning device 100 may be used to remove debris and/or residue from the firing chamber and/or barrel of a firearm. For example, at least a portion of the firearm cleaning device 100 may be inserted into the firing chamber and/or barrel of a firearm. In some instances, the firearm may be a semi-automatic rifle, an automatic rifle, a shotgun, and/or a handgun. Other types of firearms may be cleaned by the firearm cleaning device 100. The firearm cleaning device 100 may clean the firing chamber and/or barrel without disassembling the firearm. The firearm cleaning device 100 may be a motorized handheld device that is easily transportable. In this manner, the firearm cleaning device 100 may be used for performing immediate cleaning action to a firearm in a field environment or the like.

The firearm cleaning device 100 may include a housing 102. The housing 102 may include a grip portion 104. The grip portion 104 may comprise an elongated griping surface that a user may grasp. The grip portion 104 may be any size, shape, or configuration. The housing 102 also may include a motor housing portion 106 disposed opposite the grip portion 104. The motor housing portion 106 may be any size, shape, or configuration. In addition, the housing 102 may include a neck portion 108 disposed between the grip portion 104 and the motor housing portion 106. The neck portion 108 may include a front-to-back thickness less than the grip portion 104 and/or the motor housing portion 106. The next portion 108 may include any size, shape, or configuration.

Figure 3:
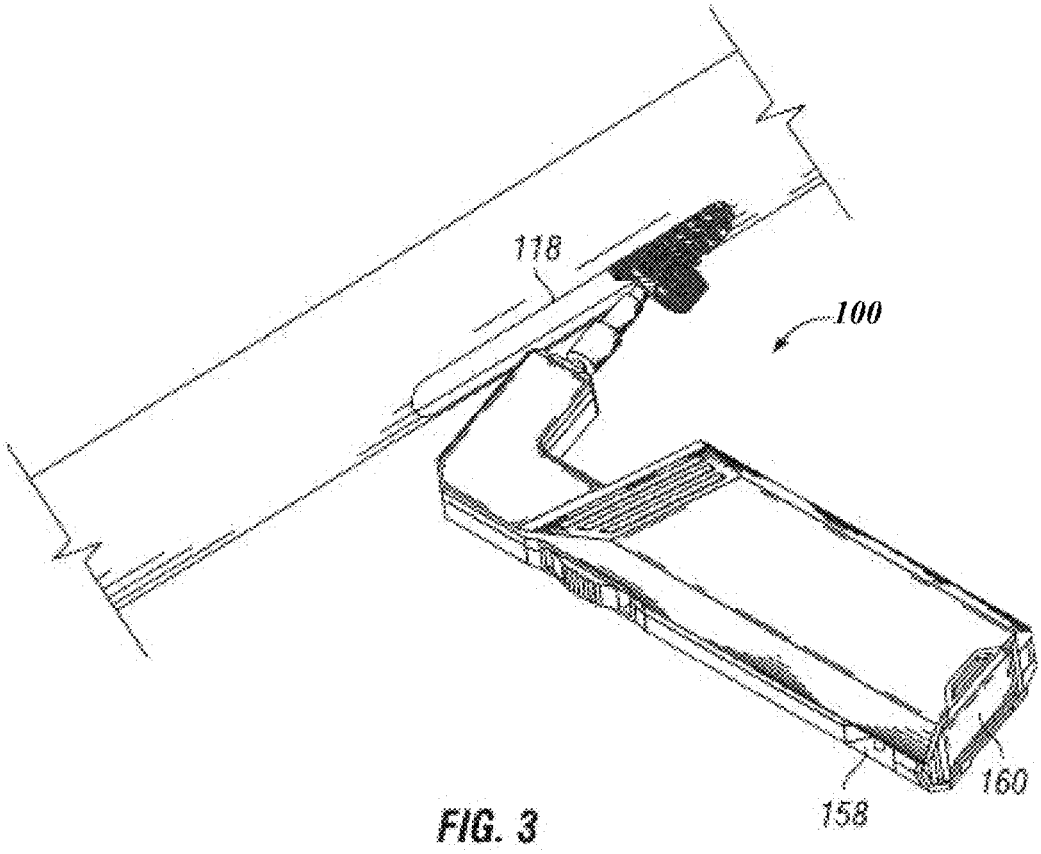
FIG. 3 depicts a firearm cleaning device partially inserted into a firing chamber in accordance with one or more embodiments of the disclosure.
Figure 4:
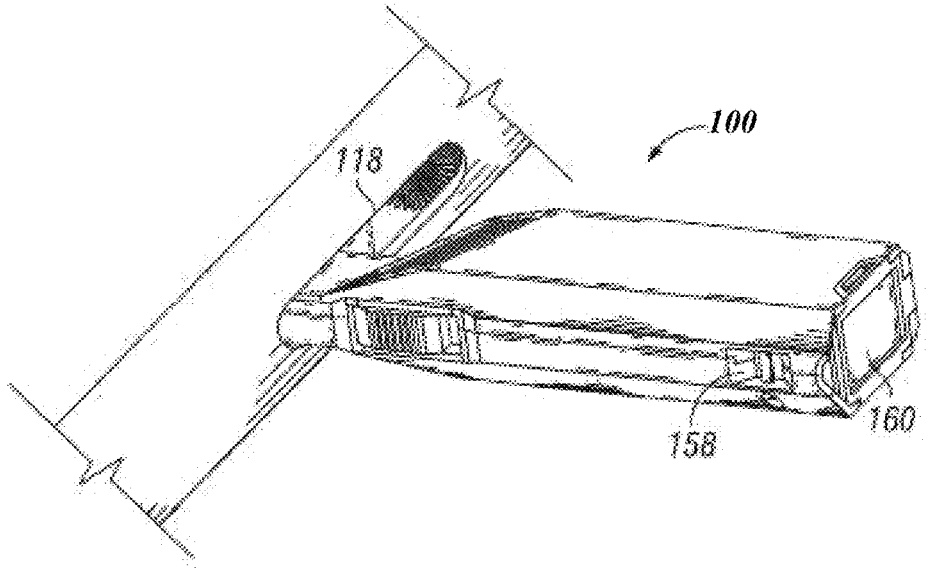
FIG. 4 depicts a firearm cleaning device partially inserted into a firing chamber in accordance with one or more embodiments of the disclosure.

A slot 110 in the housing 102 may be disposed adjacent to the neck portion 108 between the grip portion 104 and the motor housing portion 106. The slot 110 may be any size, shape, or configuration. In some instances, the slot 110 may be generally U-shaped. In other instances, the slot 110 may be defined between three surfaces of the housing 102. For example, the slot 110 may be defined by a bottom wall 112 of the motor housing portion 106, a side wall 114 of the neck portion 108, and an upper angled wall 116 of the grip portion 104. In this manner, the housing 102 may include a hook-like configuration. As depicted in FIGS. 3 and 4, the hook-like configuration of the housing 102 may facilitate the insertion of at least a portion of the housing 102 into a firing chamber 118 and barrel of a firearm.

Figure 2:
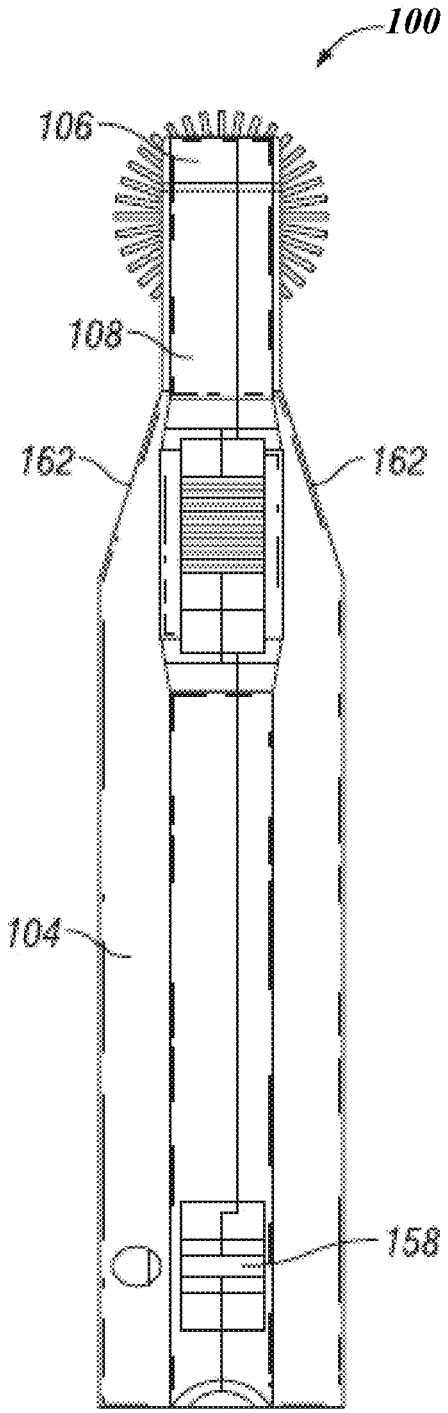
FIG. 2 depicts a firearm cleaning device in accordance with one or more embodiments of the disclosure.
Figure 5:
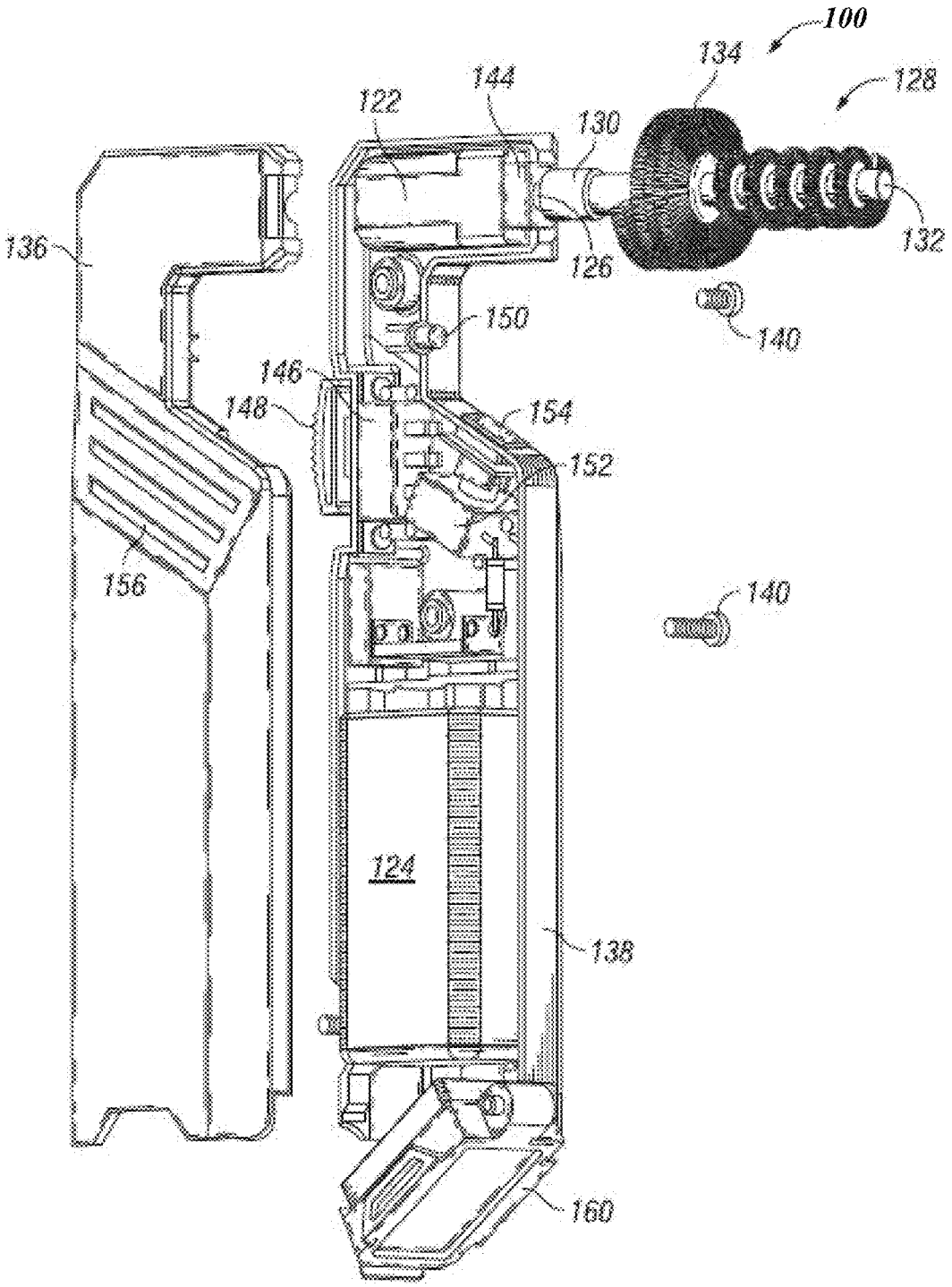
FIG. 5 depicts an exploded view of a firearm cleaning device in accordance with one or more embodiments of the disclosure.

In some instances, the grip portion 104 may include one or more angled surfaces 120 for providing a visual and tactile alignment reference for correct insertion of the firearm cleaning device 100 into the firing chamber 118 and barrel of the firearm. A side-to-side width of the housing 102 may be less than a front-to back thickness of the housing 102 such that the housing 102 may be grasped by the hand of a user. In some instances, as depicted in FIG. 2, a side-to-side width of the neck portion 108 and the motor housing portion 106 may be less than a side-to-side width of the grip portion 104. In this manner, an angled surface 162 may transition between the grip portion 104 and the neck portion 108. The smaller neck portion 108 and the motor housing portion 106 may facilitate insertion into the firearm chamber and/or barrel of a firearm. The housing 102 may be any size, shape, or configuration. In some instances, the grip portion 104, the neck portion 108, and the motor housing portion 106 may be integrally formed. In certain embodiments, as depicted in FIG. 5, the housing 102 may be formed by a first half 136 attached to a second half 138. The first half 136 may be attached to the second half 138 by one or more screws 140. The housing 102 may be made out of any suitable material, including, but not limited to, plastics, metals, composites, or polymers.

Still referring to FIG. 5, the firearm cleaning device 100 may include a motor 122 disposed within the motor housing portion 106. In addition, a battery 124 may be disposed within the grip portion 104. The battery 124 may be electrically coupled to the motor 122. The motor 122 may be any suitable electrical motor. Similarly, the battery 124 may be any suitable battery capable of providing adequate power to the motor 122. In some instances, the battery 124 may be rechargeable.

A shaft 126 may be coupled to the motor 116. The shaft 126 may extend at least partially out of the motor housing portion 106. The shaft 126 may be generally transverse to a vertical axis of the housings 102. The shaft 126 may be configured to rotate when the motor 122 is activated. The shaft 126 may be any size, shape, or configuration.

In some instances, a detachable brush 128 may be attached to and from the shaft 126. In this manner, detachable brushes 128 of various sizes may be used. For example, the detachable brush 128 may include a shaft coupling 130 attached to a brush shaft 132. The brush shaft 132 may include a number of bristles 134 extending therefrom. In some instances, the bristles 134 may be substantially transverse to the brush shaft 132. The shaft coupling 130 may be threaded onto the shaft 126. That is, the shaft 126 may include external threads, and the shaft coupling 130 may include complementary internal threads. Any attachment means may be used to attach and detach the detachable brush 128 to the shaft 126. The brush shaft 132 may extend coaxially with the shaft 126. In some instances, the detachable brush 128 may not be detachable, but instead permanently attached to the shaft 126. The detachable brush 128 may be any size, shape, or configuration.

Figure 6A:
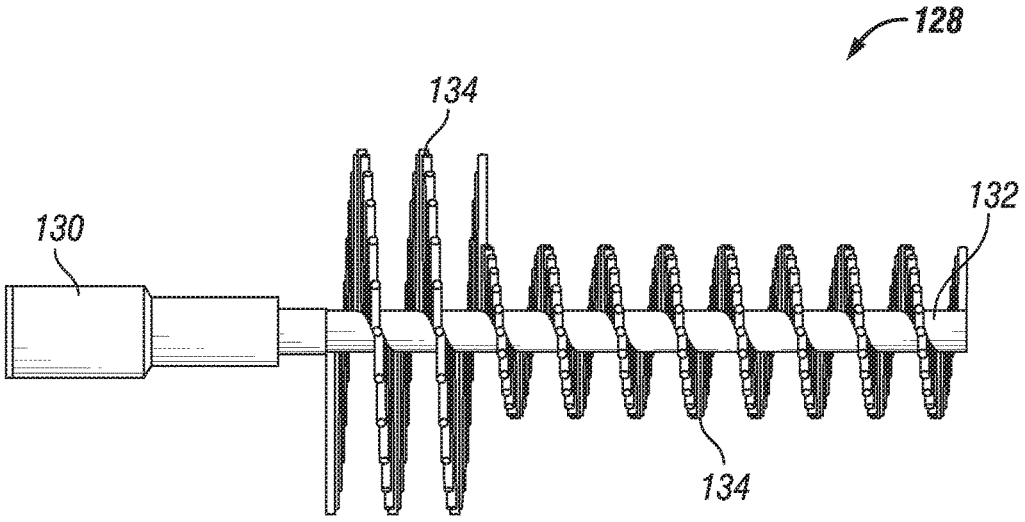
FIG. 6A depicts a detachable brush in accordance with one or more embodiments of the disclosure.
Figure 6B:
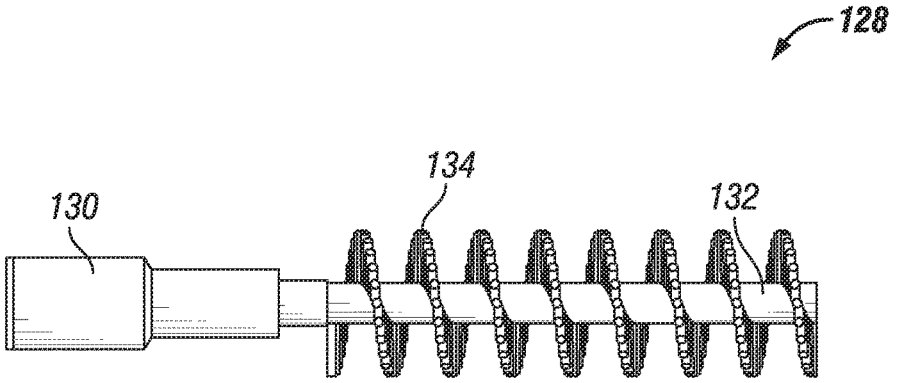
FIG. 6B depicts a detachable brush in accordance with one or more embodiments of the disclosure.

As depicted in FIGS. 6A and 6B, the bristles 134 may be any size, shape, or configuration. In some instances, the bristles 134 may be variable sized bristles. That is, the diameter of the bristles 134 may vary along a length of the brush shaft 132. In some instances, the bristles 134 may have a greater diameter closer to the shaft coupling 130. The bristles 134 may form a spiral about the brush shaft 132. In a first embodiment, a first set of the bristles 134 may include a diameter of about 20 mm and a second set of bristles may include a diameter of about 10 mm. In a second embodiment, a first set of the bristles 134 may include a diameter of about 25 mm and a second set of bristles may include a diameter of about 12 mm. In a third embodiment, the bristles 134 may include a uniform diameter of about 12.5 mm. In a fourth embodiment, the bristles 134 may include a uniform diameter of about 10 mm. The bristles 134 may be any diameter. In some instances, the diameter of some or all of the bristles 134 may be shorter than a typical size for a respective caliber. In other instances, bristles 134 may be equal to or greater than a typical size for a respective caliber. In this manner, the bristles 134 may be readily inserted into the firing chamber and/or barrel. The length of the brush shaft 132 and the bristles 134 may vary. For example, the length may vary from about 10 mm to 45 mm. The bristles 134 may vary in size to accommodate various caliber firearms. The bristles 134 may vary in size to effectively clean the firing chamber and/or barrel at the designed speed of the motor 122. The bristles 134 may comprise a variety of materials, including, but not limited to, plastics, metals, a composite, or a polymer. The bristles 134 may be designed to rotate within the firing chamber and/or barrel.

Figure 7A:
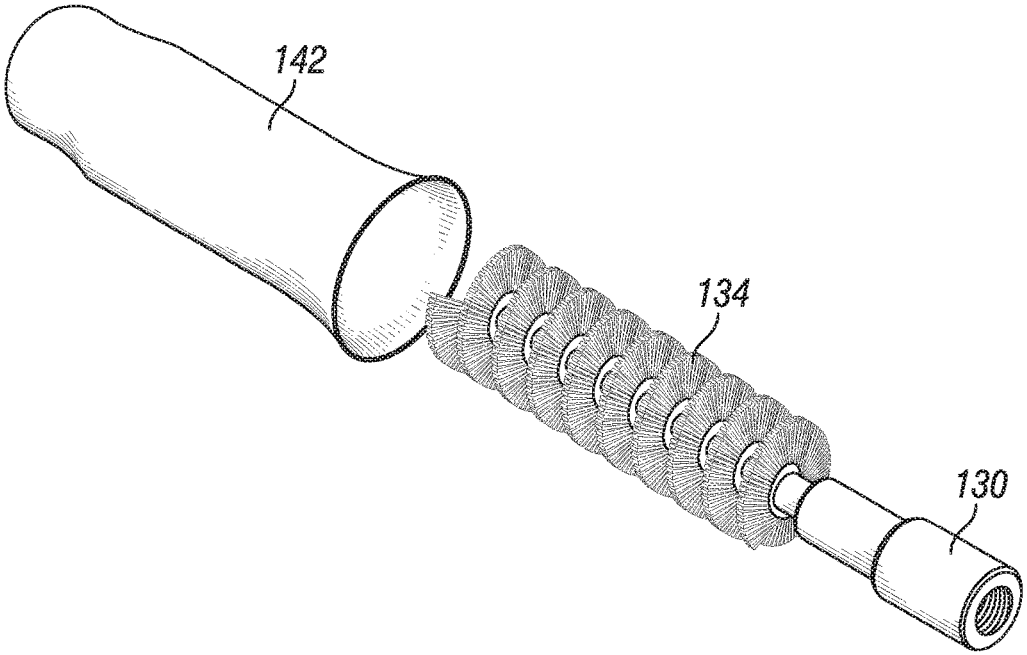
FIG. 7A depicts a detachable brush and brush sock in accordance with one or more embodiments of the disclosure.
Figure 7B:
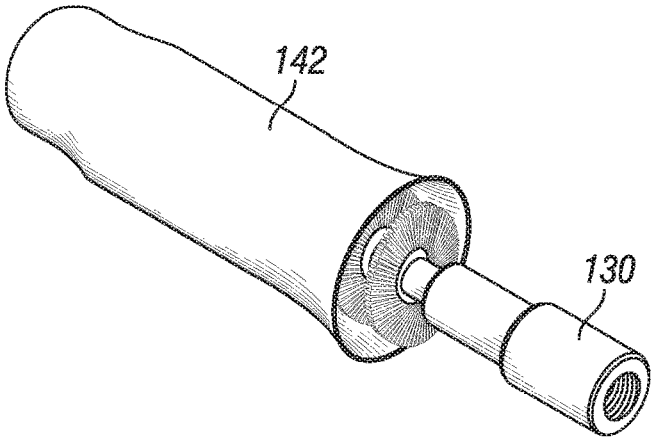
FIG. 7B depicts a detachable brush and brush sock in accordance with one or more embodiments of the disclosure.

In certain embodiments, as depicted in FIGS. 7A and 7B, a brush sock 142 may be positioned over the detachable brush 122. In some instances, the brush sock 142 may comprise a fabric brush cover that may be placed over the bristles 134 to provide a similar function to a cotton bore swab. The brush sock 142 may be discarded after use with little expense, requires no brush removal, and since it is pressed against the firing chamber and/or barrel wall by the bristles 134, it may facilitate more efficient cleaning.

In some instances, as depicted in FIG. 5, a reduction gear 144 may be disposed between the motor 122 and the shaft 126. In some instances, the motor 122 and the reduction gear 144 may be a single component integrally formed. In other instances, the motor 122 and the reduction gear 144 may be separate components. In some instances, the motor 122 may run at 32,000 RPM, and the reduction gear 144 may include a gear ratio of 100:1. In this manner, the shaft 126 may rotate at about 320 RPM. The motor may run at any RPM. Similarly, the reduction gear 144 may have any gear ratio to provide suitable torque. For example, the battery 124, motor 122, and reduction gear 144 may provide a torque of about 100 gf/cm.

The firearm cleaning device 100 may include a motor switch 146 disposed about the housing 102 opposite the slot 110. In some instances, the motor switch 146 may be located on a backside of the housing 102. In one embodiment, a user may grasp the housing 102 and manipulate the motor switch 146 with their thumb. The motor switch 146 may be located anywhere about the housing 102. The motor switch 146 may be electrically coupled to the battery 124 for activating the motor 122. In some instances, the motor switch 146 may include an actuator knob 148 located on a backside of the housing 102.

The firearm cleaning device 100 also may include a light 150 disposed on the neck portion 108 within the slot 110. The light 150 may illuminate the firing chamber and/or barrel of the firearm. The light 150 may be electrically coupled to the battery 124. In some instances, the light 150 may be an LED light or the like. The light 150 may be any type of light. The light 150 may be any size, shape, or configuration. A light switch 152 may be disposed on the grip portion 104 within the slot 110. The light switch 152 may be located anywhere about the housing 102. The light switch 152 may be used for activating the light 150. The light switch 152 may include an actuator knob 154 disposed on upper angled wall 116 of the grip portion 104. In this manner, in one embodiment, a user may grasp the housing 102 and use their trigger finger to manipulate the light switch 152.

The firearm cleaning device also may include one or more ventilation slits 156 in the housing 102. The one or more ventilation slits 156 may provide ventilation for the electrical components disposed within the housing 102. The ventilation slits 156 may be disposed on the grip portion 104 away from the motor housing portion 106 to avoid exposing the motor 122 to debris. The ventilation slits 156 may be located anywhere on the housing 102. The ventilation slots 156 may be any size, shape, or configuration. A lanyard attachment point 158 may be disposed about the housing 102. The lanyard attachment point 158 may be located anywhere about the housing 102. The lanyard attachment point 158 may be any size, shape, or configuration. In addition, a removable panel 160 may be attachable to the grip portion 104 for accessing the battery 124 within the grip portion 104. That is, the removable panel 160 may be disposed on a bottom portion of the housing 102. In some instances, the removable panel 160 may be pivotally attached to the grip portion 104. The removable panel 160 may be located anywhere about the housing 102. The removable panel 160 may be any size shape or configuration.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A device for cleaning firearms, the device comprising:

a housing comprising a grip portion, a motor housing portion opposite the grip portion, a neck portion disposed between the grip portion and the motor housing portion, and a slot disposed adjacent to the neck portion between the grip portion and the motor housing portion;

a motor disposed within the motor housing portion;

a battery disposed within the grip portion, wherein the battery is electrically coupled to the motor;

a shaft coupled to the motor and extending out of the motor housing portion;

a detachable brush attachable to the shaft, wherein the detachable brush comprises a shaft coupling and bristles, wherein the shaft coupling is threaded onto the shaft;

a motor switch disposed about the housing opposite the slot for activating the motor;

a light disposed on the neck portion within the slot;

a light switch disposed on the grip portion within the slot for activating the light;

one or more ventilation slits in the housing;

a lanyard attachment point disposed about the housing;

a removable panel attachable to the grip portion for accessing the battery within the grip portion; and a reduction gear disposed between the motor and the shaft.

2. The device of claim 1, wherein the light comprises an LED light.

3. The device of claim 1, wherein the bristles comprise variable sized bristles.

4. The device of claim 1, further comprising a brush sock positionable over the detachable brush.

* * * * *